US005577628A

United States Patent [19]

O'Neil et al.

[11] Patent Number: 5,577,628

[45] Date of Patent: Nov. 26, 1996

[54] HAMPER WITH BI-DIRECTIONAL OPENING LID

[75] Inventors: Robert A. O'Neil, Glen Ellyn; Kevin Short, Midlothian; James Kyroudis, Chicago, all of Ill.

[73] Assignee: Tucker Housewares, Leominster, Mass.

[21] Appl. No.: 527,574

[22] Filed: Sep. 13, 1995

[51] Int. Cl.[6] ..... B65D 43/16

[52] U.S. Cl. ..... 220/343; 220/334

[58] Field of Search ..... 220/4.22, 4.23, 220/4.24, 329, 332, 333, 334, 337, 338, 341, 343; 206/551; 229/116

[56] References Cited

U.S. PATENT DOCUMENTS

| | | | |
|---|---|---|---|
| 3,360,152 | 12/1967 | Leers | 220/4.24 |
| 3,620,403 | 11/1971 | Rump | 206/551 X |
| 4,811,846 | 3/1989 | Bottega | 206/551 X |
| 5,356,027 | 10/1994 | Craft et al. | 220/338 |

FOREIGN PATENT DOCUMENTS

| | | | |
|---|---|---|---|
| 4118071 | 12/1992 | Germany | 220/333 |
| 262931 | 12/1926 | United Kingdom | 220/337 |
| 1142017 | 2/1969 | United Kingdom | 220/338 |

*Primary Examiner*—Allan N. Shoap
*Assistant Examiner*—Nathan Newhouse
*Attorney, Agent, or Firm*—Darby & Darby, P.C.

[57] ABSTRACT

A hamper having a three-sided base with a front wall and a pair of side walls connected to form an open top. A lid fits over the base top and there are mating cooperating hinge parts on each of the two side walls of the lid and base to permit the lid to be pivoted relative to either of the base side walls between open and closed positions.

13 Claims, 2 Drawing Sheets

40
25
26L
24
22
28
42
3
40
40
30
42
24
26R
3
40
32
42
30
18
32
24
14L
18
14R
20
10
12
13
16

HAMPER WITH BI-DIRECTIONAL OPENING LID

FIELD OF THE INVENTION

This invention relates to hampers, such as a clothes hamper, having a lid which can be opened in different directions.

BACKGROUND OF THE INVENTION

Various types of hampers are in widespread use. Typical of these is a clothes hamper in which soiled clothes are stored prior to washing. One such type of clothes hamper is injection molded of plastic material and has a base and a cover. The hamper base has an open top which can be of any desired shape, e.g., square, rectangular, circular, etc. The cover has a corresponding shape and is made of a somewhat flexible material to have a snap-type fit over the periphery of the base open top.

In some cases, a hamper must be used in a restricted space environment. For example, it can be located in a room corner. Using a circular type hamper in a room corner wastes space. Also, the hamper must be pulled out of the corner to open the lid by snapping, or prying it, off of the complete periphery of the base top. A similar problem exists with covered containers of square and rectangular shape in that once the cover has been fully fastened onto the four walls of the top of the base, it must be unfastened from each of these walls. If the cover is not fastened, it can become detached and lost or damaged.

BRIEF DESCRIPTION OF THE INVENTION

The present invention relates to a hamper with a cover attached by a hinge. In accordance with the invention, the hamper base had a shape of a quadrant of a circle, or is generally triangular, with two vertical side walls connected substantially transversely and a connecting front wall. The hamper includes a lid of an overall shape corresponding to the open top of the base. There are mating hinges on each of the two side walls of each of the hamper base and lid.

The hinge arrangement permits the lid to be pivoted relative to either of the base side walls so that it is bi-directional. The lid can be firmly attached to the base top on either of the side walls and the lid can be opened without detaching it completely from the base. Also, the hinge arrangement is such that the cover can be opened from the front, where there is no hinge, and pivoted about either one of the base side walls to an open position. The hamper can be located in a room corner and the lid selectively opened from the front to either the right or the left.

OBJECTS OF THE INVENTION

It is an object of the invention to provide a hamper with a bi-directional hinged lid.

A further object is to provide a hamper of a shape generally of a quadrant of a circle having a bi-directional hinged lid movable to each side of the hamper.

Yet another object is to provide a hamper whose base has essentially three walls and a lid for the base which is hinged to rotate on each of two of the three walls.

Still a further object is to provide a hamper formed of two vertical side walls connected by a curved front wall and a cover which is pivotably hinged on each of the side walls to selectively open in opposite directions.

BRIEF DESCRIPTION OF THE DRAWINGS

Other objects and advantages of the present invention will become more apparent upon reference to the following specification and annexed drawings in which.

DETAILED DESCRIPTION OF THE INVENTION

Figure 1:
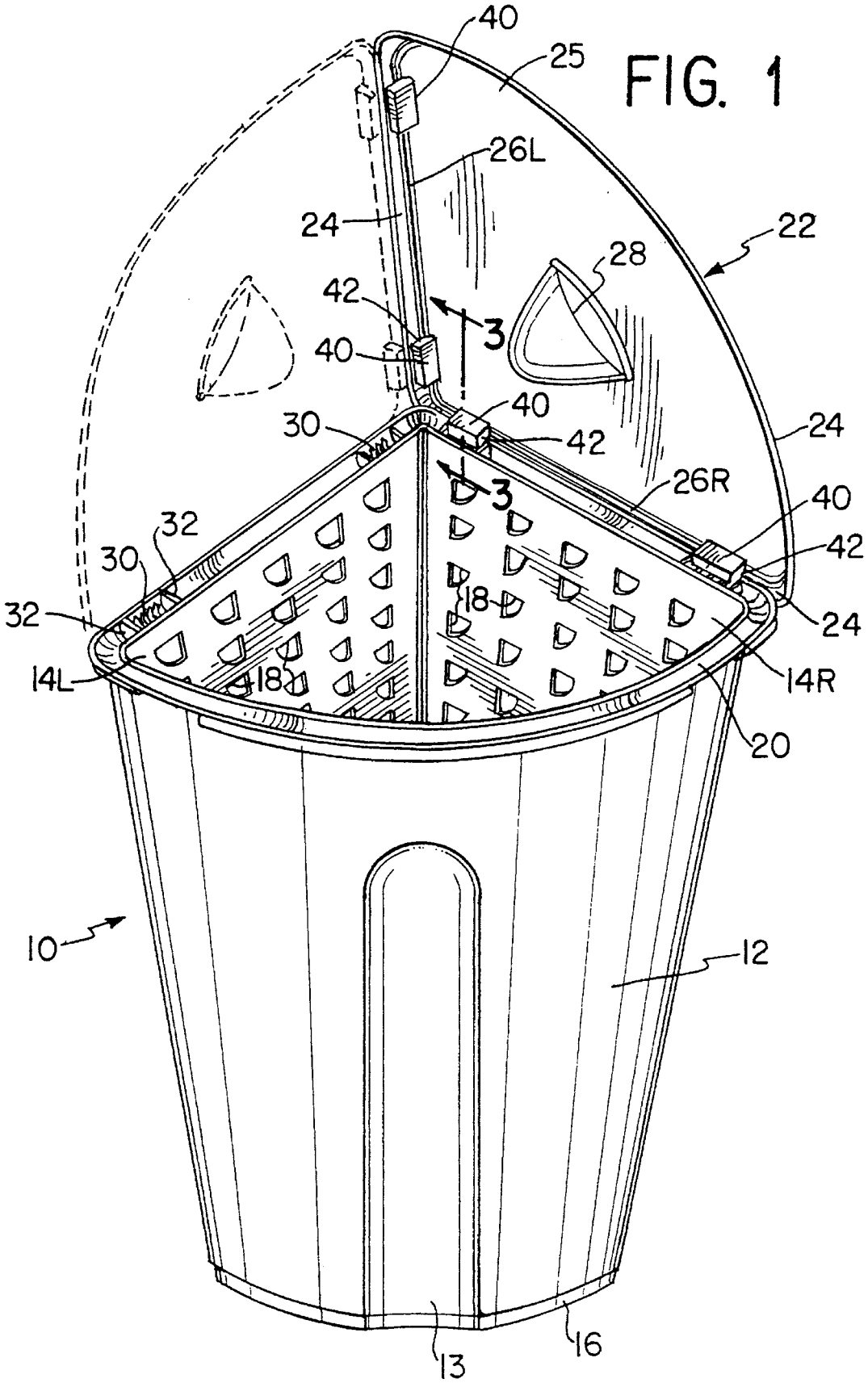
FIG. 1 is a top front perspective view of the hamper with lid open.

Pursuant to the drawings, FIG. 1 shows the hamper as having a base 10 which is generally of the shape of a quadrant of a circle. The base 10 has a curved front wall 12 which connects one edge of each of two vertical side walls 14L and 14R whose other edges are connected to place the side walls 14 generally transverse to each other. A bottom wall 16 connects the front and side walls 12 and 14. As also seen in FIG. 1, the container side walls 14 have a plurality of openings 18 for ventilation purposes. The openings 18 can be formed in any desired decorative pattern. The walls form, from a top view, a quarter-section of a circle. If desired, the front wall 12 can be flat so that the open top of the base 10 is generally triangular.

The base 10 is made of suitable plastic material, such as polyethylene or polypropylene, by a suitable process such as injection molding. The container walls 12, 14 can be angled slightly inwardly to join the base bottom wall 16 so that a number of bases 10 can be nested one within the other for shipping and storage.

A peripheral lip 20 surrounds the upper edge of each of the front and side walls 12 and 14. Lip 20 is concave and extends outwardly from the respective base walls 12 and 14. The shape of the lip 20 is basically a quadrant, or a quarter section, of a circle. In the peripheral lip portion 20 of each of the two side walls 14, adjacent each of the ends of each side wall, is a male hinge part 30, which is described in detail below.

A lid 22 is used to cover the open top of the hamper base 10. The lid is of a shape conforming to the hamper base 10 open top, that is, it is essentially a quarter-section of a circle. It has a front portion 25 of a shape generally corresponding to the base front wall 12 and straight sides 26L and 26R which correspond to the base side walls 14L and 14R. The inner well of the lid is also provided with a pocket 28 in which a deodorizer pellet can be placed. Lid 22 also is injection molded and is preferably somewhat flexible.

Lid 22 has a peripheral extending lip 24 which is of a shape corresponding to and is somewhat larger than the base lip 20. The lid lip 24 overlies, but is spaced from, the base lip 20 when the lid 22 is fully fastened to the base top and when it is moved between open and closed positions (see FIGS. 3 and 4). A male hinge part 40 is formed in a pocket 41 in the lid lip 24 on each of the lid side walls 26 adjacent each side wall end. Each male hinge part 40 is positioned to mate with a corresponding female hinge part 30 of the base 10. If desired, three or more hinges can be located on each of the base and lid walls. Also, there can be more hinges on one side wall than on the other, for example, two on one wall and one on the other.

As can be seen in FIG. 1, the lid 22 can be pivoted about the hinges 30, 40 on either of the base 10 and lid 22 side walls 14. For example, the lid can be closed and then pivoted on the right side wall 14R, as shown by the solid lines. It can then be closed again and pivoted on the left side wall 14L as shown by the dotted lines.

Figure 2:
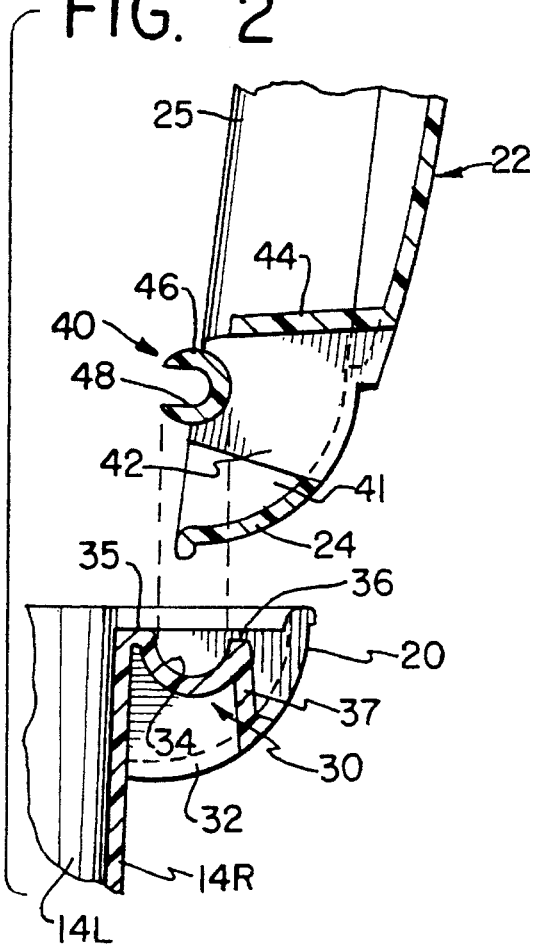
FIG. 2 is a cross-sectional view of a portion of each of the lid and base showing the hinge components with the lid separated from the base, taken along lines 3—3 of FIG. 1.
Figure 3:
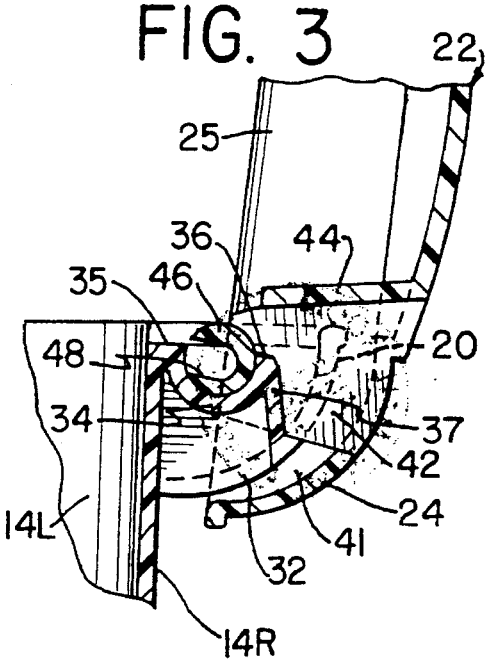
FIG. 3 is a cross-sectional view taken along lines 3—3 of FIG. 1 with the lid open.
Figure 4:
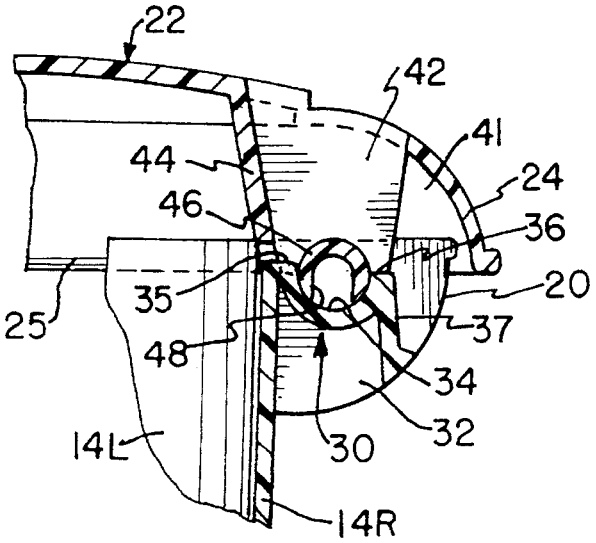
FIG. 4 is a cross-sectional view with the lid closed.

Referring to FIGS. 2–4, the construction of one of the hinges is described. The construction of each of the other hinges is the same.

Within the base peripheral lip 20 the female hinge part 30 has a pair of spaced vertical walls 32. A semi-circular hinge channel 34 spans the length of the section between the spaced vertical walls 32. One edge 35 of the hinge channel 34 is connected to its adjacent base side wall 14. The other edge 36 of the channel 34 is supported by one end of a support arm 37 whose other end is connected to the peripheral lip 20.

Each of the male hinge parts 40 is formed in a respective pocket 41 of the lid peripheral lip 24. The parts of the hinge 40 are molded as the lid is molded. Hinge 40 has spaced vertical side walls 42 and a connecting front wall 44, all of which depend downwardly from the lid 22. Suspended between the spaced male hinge part side walls 42 is a hinge pin 46 of generally C-shape having an open center 48. The ends of the C-shape hinge pin 46 extend below the lower edge 25 of the lid peripheral lip 24.

The hinge pin 46, due to its open center 48, is somewhat compressible. It is made of a size to extend into and form a tight interference fit with the C-shaped channel 36 of the female hinge part 30. As shown best in FIG. 4, there is basically a compressive snap tight fit of a hinge pin 46 of the male hinge part 40 within the channel 34 of the female hinge part 30.

In use of the hamper, the lid 22 is placed over the base open top with the hinge parts 30, 40 of each hinge aligned. Slight downward pressure at each of the points where there is a pocket 41 defining the male hinge part 40 snaps its hinge pin 46 into the mating channel 34 of the underlying female hinge part 30. If it is desired to fully remove the lid from the base, it is only necessary to pry up each corner of the side walls 26 of the lid to disengage the hinge pin 46 of the lid male hinge part 40 from the channel 34 of the base female hinge part.

If it is desired to open a closed lid, the hinges on the side wall 26L or 26R of the lid 22 which is to be opened are disengaged and the lid is pivoted relative to the base on the hinges 30–40 on the other side wall which are still connected. The user can grasp the lid front wall 25 and pivot the lid about the hinges that are engaged. In FIG. 1, it is seen in the solid line representation that pivoting occurs around the hinges on the right side wall 14R of the base and the right side wall 26R of the lid. That is, the hinges on walls 14L and 26L are disengaged. As the lid 22 is moved, the lid lip 24 passes over the base lip 20. The user closes the lid from the solid line position shown in FIG. 1 by lowering it. Usually, the weight of the lid will be sufficient to lower it to a closed position. The hinges parts 30 on the side of the lid being lowered back onto the base do not engage the underlying male hinge parts 40 until pressure is applied to snap the hinge parts together.

As seen, upon the hamper 10 being set in place, the user can open the lid 22 in either direction once the pair of hinges on the walls 14, 26 of the hamper about which pivoting is to take place are engaged. Of course, the lid 22 can be laid over the base open top without the base and lid hinge parts being engaged.

The hinges on the side wall 14L, 26L can be re-engaged by applying a slight downward pressure to the outer surface of the lid in the area of the side wall hinge part pocket 41. The lid can then be opened to the other side, as shown by the dotted line, by disengaging the hinge parts of the side walls 14R, 26R and pivoting the lid about the hinge parts on the walls 14L and 26L with the hinges on the side walls 14R 26R of the open side of the base disengaged. The lid can thereafter be opened as desired and closed by pivoting the lid about the hinges on walls 14L, 26L.

We claim:

1. A hamper consisting of: three upstanding non-parallel walls, said walls including:

a front wall, a pair of side walls connected to each other at an angle and a bottom wall connected to form a three-sided base with a three-sided open top;

a lid to cover the base open top having a front wall and side walls connected to each other at an angle and having a shape corresponding to the three sided open top formed by the base front and side walls; and hinge means comprising a respective cooperating separable part on each said base side wall and each said lid side wall for selectively pivoting the lid between open and closed positions of said base three-sided open top relative to either one of the angularly connected base side walls.

2. A hamper as in claim 1 wherein said hinge means comprises a pair of cooperating hinge parts spaced apart on each of said base and lid side walls.

3. A hamper as in claim 2 wherein each of said hinge means on one of said base and lid side walls comprises a respective piece forming an open channel and each of the hinge means on the other of said base and lid side walls comprises a hinge pin that fits in and rotates relative to said channel.

4. A hamper as in claim 3 wherein a said hinge pin is generally C-shaped and has a tight engaging fit within its corresponding channel.

5. A hamper as in claim 4 wherein said hinge pin is disposed between a pair of walls extending from the other of said lid and base side walls.

6. A hamper as in claim 5 wherein said hinge pin is compressible.

7. A hamper as in claim 1 wherein said hinge parts on one of said base and lid side walls comprises a piece forming an open channel and the hinge means on the other of said base and lid side walls comprises a hinge pin that fits in and rotates relative to said channel.

8. A hamper as in claim 7 wherein a said hinge pin is generally C-shaped and has a tight engaging fit within its corresponding channel.

9. A hamper as in claim 7 wherein said piece forming said channel is disposed between a pair of walls extending from the said one of the lid and base side walls.

10. A hamper as in claim 9 wherein said hinge pin is disposed between a pair of walls extending from the other of said lid and base side walls.

11. A hamper as in claim 1 wherein said base has a concave curved upwardly extending peripheral lip on the upper edge of at least its side walls, the hinge means of the base located within said base peripheral lip, said lid having a convex curved downwardly extending peripheral lip on the outer edge of at least its side walls that overlies the peripheral lip of the base.

12. A hamper as in claim 11 wherein the lid hinge means is located in the lid peripheral lip.

13. A hamper as in claim 1 where the connected side walls of each of the base and lid are at an angle of substantially 90° with respect to each other.

* * * * *